US007841377B2

(12) United States Patent
Coenraets

(10) Patent No.: US 7,841,377 B2
(45) Date of Patent: Nov. 30, 2010

(54) CLOSURE DEVICE WITH A SCREEN PRESENTING FLEXIBLE SIDE EDGES

(75) Inventor: Benoit Coenraets, Brussels (BE)

(73) Assignee: Dynaco International S.A., Brussels (BE)

( * ) Notice: Subject to any disclaimer, the term of this patent is extended or adjusted under 35 U.S.C. 154(b) by 0 days.

(21) Appl. No.: 11/730,013

(22) Filed: Mar. 29, 2007

(65) Prior Publication Data

US 2008/0035282 A1 Feb. 14, 2008

(30) Foreign Application Priority Data

Mar. 29, 2006 (EP) ..... 06111956

(51) Int. Cl.
*A47G 5/02* (2006.01)

(52) U.S. Cl. ..... 160/268.1; 160/264; 160/273.1

(58) Field of Classification Search ..... 160/264, 160/266, 267, 271, 273.1, 310
See application file for complete search history.

(56) References Cited

U.S. PATENT DOCUMENTS

| | | | | |
|---|---|---|---|---|
| 2,349,226 | A * | 5/1944 | Thomas | 160/273.1 |
| 3,161,258 | A * | 12/1964 | Chapman | 181/287 |
| 3,583,465 | A * | 6/1971 | Youngs et al. | 160/264 |
| 5,353,858 | A * | 10/1994 | Hartmann | 160/264 |
| 5,526,865 | A * | 6/1996 | Coenraets | 160/272 |
| 6,119,758 | A | 9/2000 | Coenraets | |
| 6,431,250 | B2 * | 8/2002 | Mullet et al. | 160/273.1 |
| 7,028,741 | B2 * | 4/2006 | Coenraets | 160/273.1 |

FOREIGN PATENT DOCUMENTS

| | | |
|---|---|---|
| DE | 563 303 | 11/1932 |
| EP | 1 460 231 A2 | 9/2004 |
| WO | WO 95/30064 A1 | 11/1995 |
| WO | WO 02/25048 A1 | 3/2002 |
| WO | WO 03/048497 A1 | 6/2003 |

* cited by examiner

*Primary Examiner*—Blair M. Johnson
(74) *Attorney, Agent, or Firm*—Browdy and Neimark, PLLC

(57) ABSTRACT

The invention concerns a device comprising a screen (2) presenting flexible side edges (4) having an overthickness (4'), this screen (2) being equipped with one cable or with several juxtaposed cables (21), incompressible in their lengthwise direction, extending parallel to the side edges (4) of the screen so as to enable the application of a thrust force on these side edges (4) in their longitudinal direction to move the screen to its closed position, this cable or cables (21) being located in the neutral surface (24) of said edges (4) formed on bending of the latter and being fixed with respect to the screen (2) in an unremovable way; the overthickness comprises a flexible strip (8) made of an elastic material, wherein the cable or cables (21) are incorporated, as well as two notched belts (9, 10) being located the one with respect to the other on each of both sides of the curtain (2).

11 Claims, 4 Drawing Sheets

CLOSURE DEVICE WITH A SCREEN PRESENTING FLEXIBLE SIDE EDGES

The invention concerns a device comprising a screen presenting flexible side edges with an overthickness extending in the longitudinal direction of the side edges, this overthickness being guided by guide channels thus enabling the screen to be moved between a closed position and an open position.

This device may be used for closing a doorway or window recess or the load volume of a vehicle, such as a truck or a boat, covering a swimming pool, etc.

The difficulty in the development of such a device is that a compromise must always be sought between the flexibility and the rigidity of the side edges of the screen to prevent the various layers of which they are generally constituted from tearing or separating during the opening or closing of the screen.

In particular, when the screen is driven towards its closed position by the action of a thrust force on the side edges of the screen, the pressure exerted in the longitudinal direction of these side edges, following the friction in the guide channels, may be relatively strong. This is particularly the case for a screen with a large surface area or for a screen exposed to the wind. To prevent the side edges from jamming in the guide channels or coming out of them, it is important that these edges be sufficiently rigid and incompressible in their longitudinal direction while at the same time being sufficiently flexible and deformable by twisting.

This is not for example the case in the device which is the subject of document WO 03/048497. Indeed, this device comprises on these side edges a ridge moving in a guide channel which, on the contrary, is compressible in its longitudinal direction.

In addition, it is preferable that the side edges of the screen be flexible to allow them to come out of the guide channels when a certain force is exerted on the screen, to prevent the screen from being damaged. When the side edges are reinserted in the guide channels, they must be able to deform elastically and/or bend without being damaged and without any danger of the screen or the guide channels being damaged.

Furthermore, the side edges must present reduced friction with respect to the guide channels and be able to undergo a large number of screen opening and closing cycles, for example one to two million, without deterioration of their physical characteristics, such as, for example, their rigidity and flexibility.

It is also important that the side edges be able to bend elastically in a substantially continuous curve, i.e. in a bow shape, without forming discontinuities, such as, for example, folds. Indeed, the curvature of the side edges, which is formed elastically, for example, when the side edges are reinserted in the guide channels, must vary continuously, otherwise the screen or its side edges are liable to be damaged. This problem often arises in existing flexible-screen closure devices.

Given that the screen of the closure device according to the invention is designed to be moved at a very high speed of approximately 1 to 3 m/sec between the open position and the closed position, it is important that the side edges be very light.

In this respect, it is known, notably through document WO 03/048497, and in particular through the embodiment shown in FIG. 4, that a reinforcement 17 may be provided in a drive strip 10 forming part of a notched belt 11. It has been observed that after a certain number of screen opening and closing cycles, this reinforcement 17 comes out of and detaches itself from the drive strip, which makes it unusable.

Document WO 02/25048 shows, in FIG. 37, means of attachment formed by two flexible tapes 62 and 63 known under the brand name "Velcro" by which a metal strip 19 is attached in a removable way to the side edge of the flap 1. Also, after a certain number of flap opening and closing cycles, the tapes 62 and 63 become detached from the metal strip 19, thus necessitating costly repairs.

Furthermore, the metal strip 19 cannot twist, which is a considerable drawback in the event of this strip having to be able to free itself from its guide channel following an accident.

Lastly, if for example. the screen or a support tape for the screen is attached between two strips which are more rigid than the screen or this tape, it has been observed that there is a risk that the latter will deteriorate at the point and/or in the vicinity of the point at which it is attached between these two strips following a large number of opening and closing cycles. Such a situation is presented in particular in documents WO 95/30064 and EP 1 460 231 A2.

More particularly, document EP 1 460 231 A2 concerns a flexible sliding door comprising a support belt 2, which is produced in a material substantially similar to that of the screen 3 of which the door consists. This belt 2 is consequently necessarily more flexible than the protruding belt 11. The latter is indeed relatively thick and consists of a relatively hard composite material which, furthermore, is very inflexible. It has been observed that, after a large number of bendings to which these doors are generally subjected, the protruding belt 11 deteriorates to the point of making them unusable.

One of the essential purposes of the invention is to propose a technically and economically justified solution to all of the aforementioned problems.

For this purpose, the screen of the device according to the invention is equipped with at least one cable, substantially incompressible in its lengthwise direction, extending substantially parallel to the side edges of the screen so as to enable the application of a thrust force on these side edges in their longitudinal direction to move the screen from its open position to its closed position, the neutral surface of said side edges formed on bending of the cable being located in this cable, the latter being fixed with respect to the screen, near each of the side edges of this screen in an unremovable way preventing any movement with respect to the screen.

Advantageously, the screen is equipped with a series of several juxtaposed cables immobilised with respect to each other and extending in a plane parallel to the plane of the screen.

In a preferred embodiment of the invention, the cable or cables are held in place and preferably embedded in an elastic support.

Other details and particularities of the invention are indicated in the description given below, as a non-limitative example, of a few particular embodiments of a screen device according to the invention, with reference to the appended drawings.

In the various figures, the same reference numbers refer to identical or similar elements.

In general terms, the invention concerns a device comprising a screen which is preferably flexible and is for example formed by a tarpaulin, a net, etc. and which presents flexible side edges with an overthickness extending in the longitudinal direction of the side edges. In others embodiments, the body of the screen may be formed by a series of slats articulated with each other, extending perpendicular to its direction of movement and bordered on the side by a flexible area presenting the aforementioned overthickness.

This overthickness is guided in guide channels, thus enabling the screen to be moved between a closed position and an open position.

The screen is characterised by the fact that it is equipped with at least one cable substantially incompressible in its lengthwise direction extending parallel to the side edges of the screen. Preference is given to a series of cables extending alongside each other in the same plane and parallel to the side edges of the screen. This plane is parallel to the plane of the screen so as to enable the application of a thrust force on these side edges in their longitudinal direction to move the screen from its open position to its closed position.

"The plane of the screen 2" should be understood to mean the plane surface of the screen rolled in straight guide channels.

Another essential characteristic of the invention is that the neutral plane or surface of said side edges formed in the bending of these edges is located in the cable or cables themselves. These cables must furthermore be fixed with respect to the screen near each of the side edges of this screen in an unremovable way. This or these cables may therefore be located at the side edges of the screen or at a relatively limited distance from them.

By "neutral surface of a side edge of the screen" is understood the plane in which neither compression, nor any elongation takes place along the longitudinal direction of this edge when applying bending forces to this edge. The parts of the edge situated between the neutral surface and the centre of curvature are compressed, while the parts situated at the other site of this neutral surface are tensioned and stretched.

Figure 1:
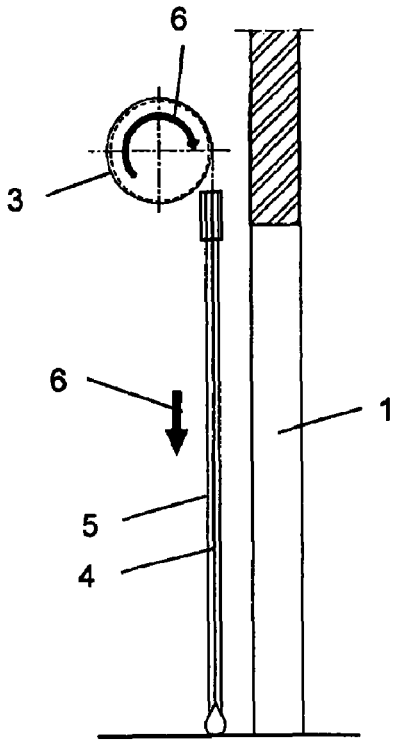
FIG. 1 is a schematic vertical cross sectional view of a screen device in the closed position.
Figure 2:
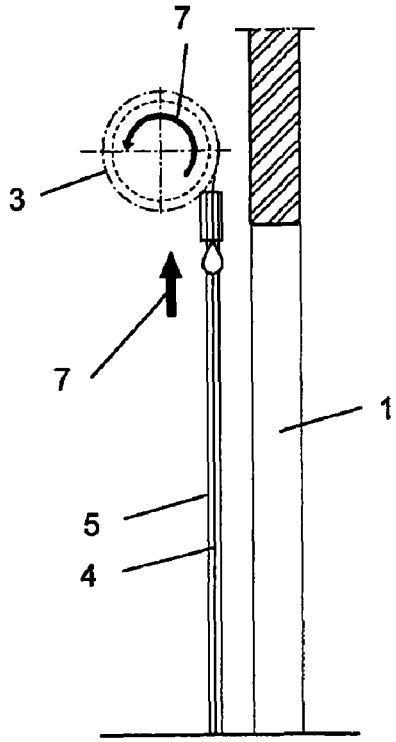
FIG. 2 is a view similar to that in FIG. 1 with the screen in its open position.
Figure 3:
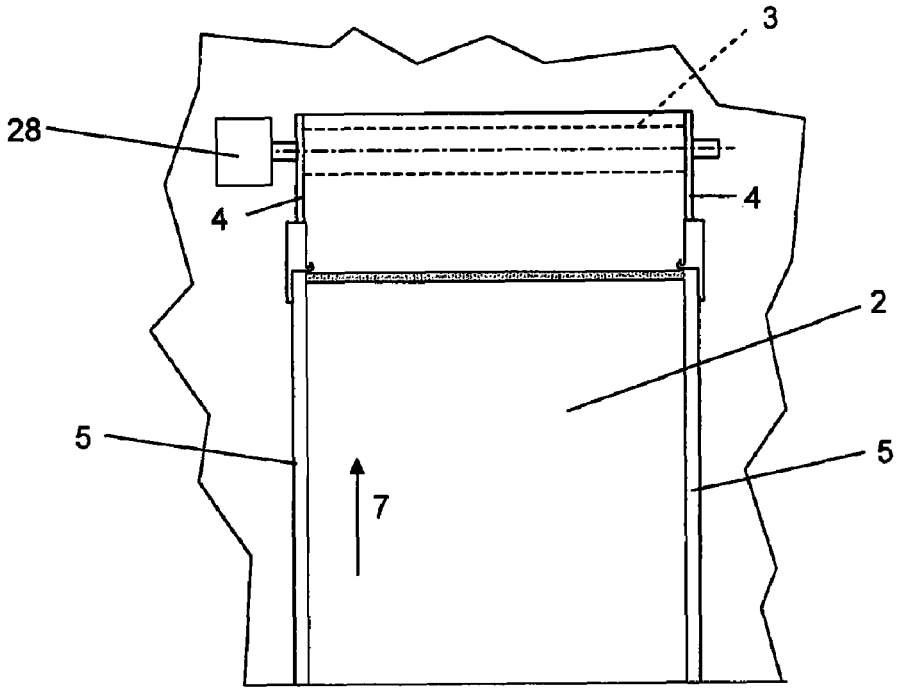
FIG. 3 is a front view of the same device, also with the screen in the open position.

FIGS. 1 to 3 show very schematically a device in which this invention, as defined above, is applicable.

In this case, this device is mounted facing a doorway 1 and comprises a screen 2 cooperating with a drum 3. The side edges 4 of this screen 2 are guided in guide channels 5.

In FIG. 1, the screen 2, after being unrolled from the drum 3 in the direction of the arrows 6, is brought into the closed position, while FIGS. 2 and 3 show the screen 2 in the open position after being rolled on the drum 3 in the direction of the arrows 7.

Figure 4:
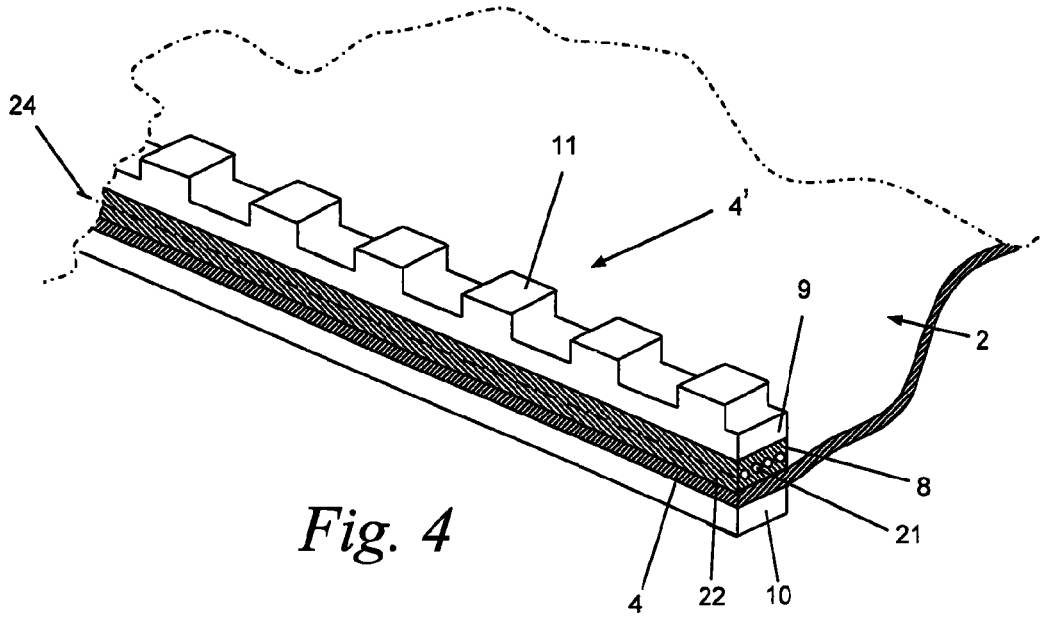
FIG. 4 is a three-dimensional view of part of the side edge of a screen of a device according to a first embodiment of the invention.

FIG. 4 concerns a first form of production of the device according to the invention.

In this embodiment, the side edges 4 are formed by an overthickness 4' which is guided in guide channels (not shown). This overthickness 4' comprises a flexible flat strip 8 in an elastic material, for example polyurethane, in which are incorporated a series of parallel cables 21 extending in the neutral surface 24 in the longitudinal direction of this strip. This strip 8 is substantially incompressible in its lengthwise and, possibly, widthwise direction and is attached in an unremovable way on one of the faces of the screen 2 at the side edges 4. It is formed by the cables 21 and a support 22 for these cables and is very little flexible or not flexible in a direction transversal to its longitudinal direction and parallel to its large faces. The strip 8 can, preferably, undergo a torsion around a longitudinal axis of it.

Thus, by applying a thrust force on these side edges 4 in the direction of the arrows 6, as indicated in FIG. 1, it is possible to move the screen 2 from its open position to its closed position.

On the face of this strip 8 opposite to that oriented towards the screen 2, a notched belt 9 is glued, whereas on the other face of the edges 4, opposite the strip 8, a non-notched belt 10 is glued.

Figure 5:
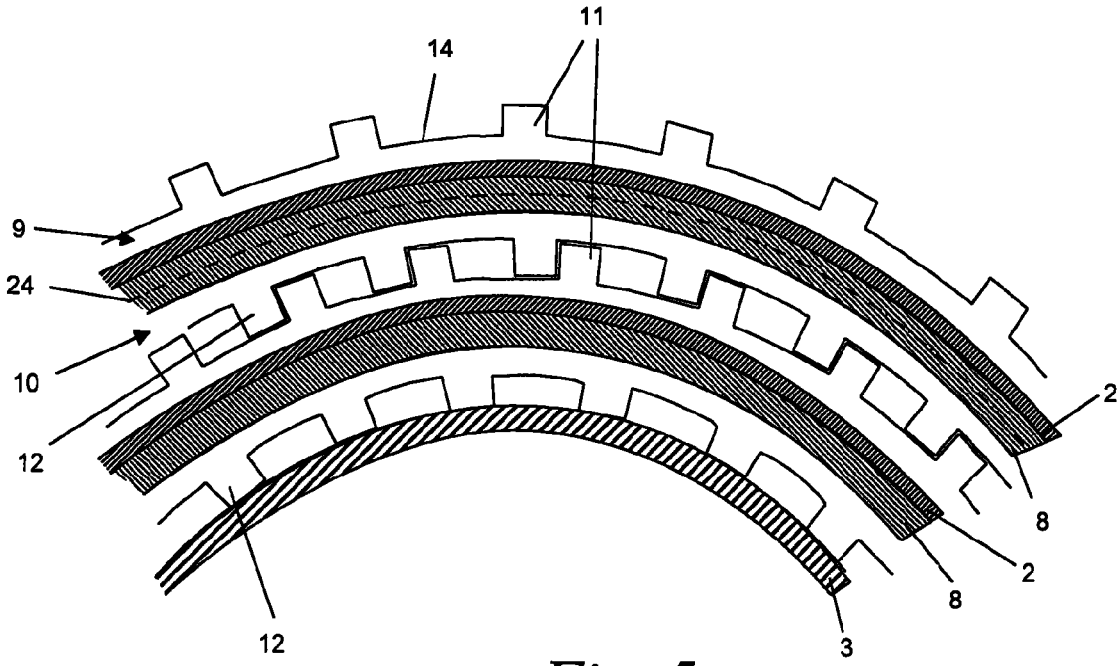
FIG. 5 is a partial longitudinal cross section of a rolled part of the side edge of a screen, according to a second embodiment of the invention.

FIG. 5 shows a embodiment in which the two belts 9 and 10 present teeth 11 or respectively 12 which mesh with each other in the rolled position of the screen 2.

On bending of the strip 8, as shown in FIG. 5, the neutral surface 24 thus obtained locates itself in the cables 21. This is very important for preventing the possibility of the belts 9 and 10 detaching themselves from the screen after a large number of screen opening and closing cycles. This applies, as is the case in this invention, to a screen which must be able to withstand between one and two million opening and closing cycles.

Figure 6:
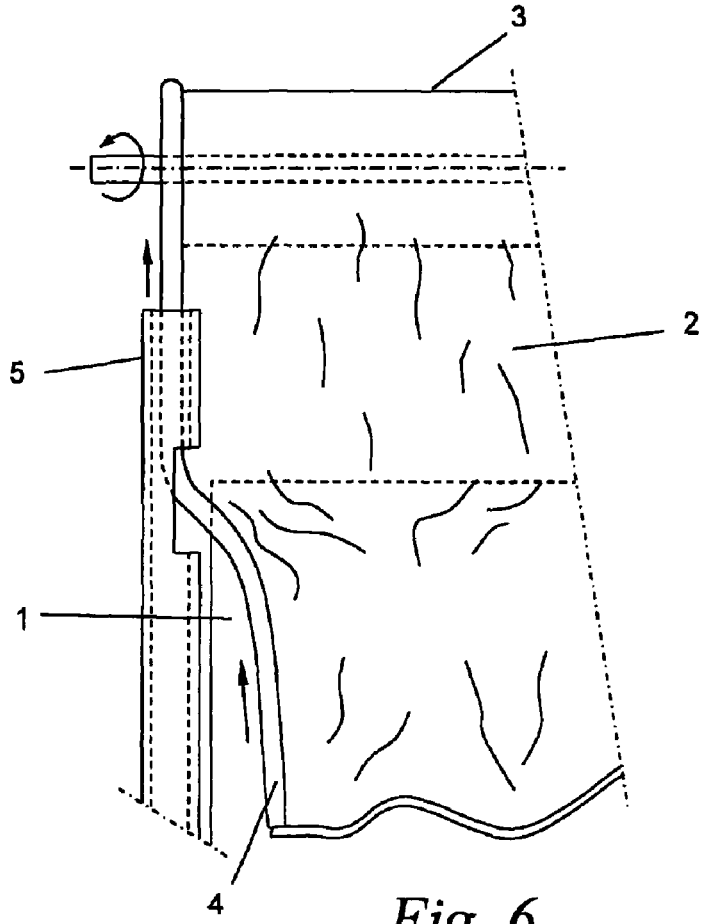
FIG. 6 is a partially broken schematic front elevation of a third particular embodiment of the invention.
Figure 7:
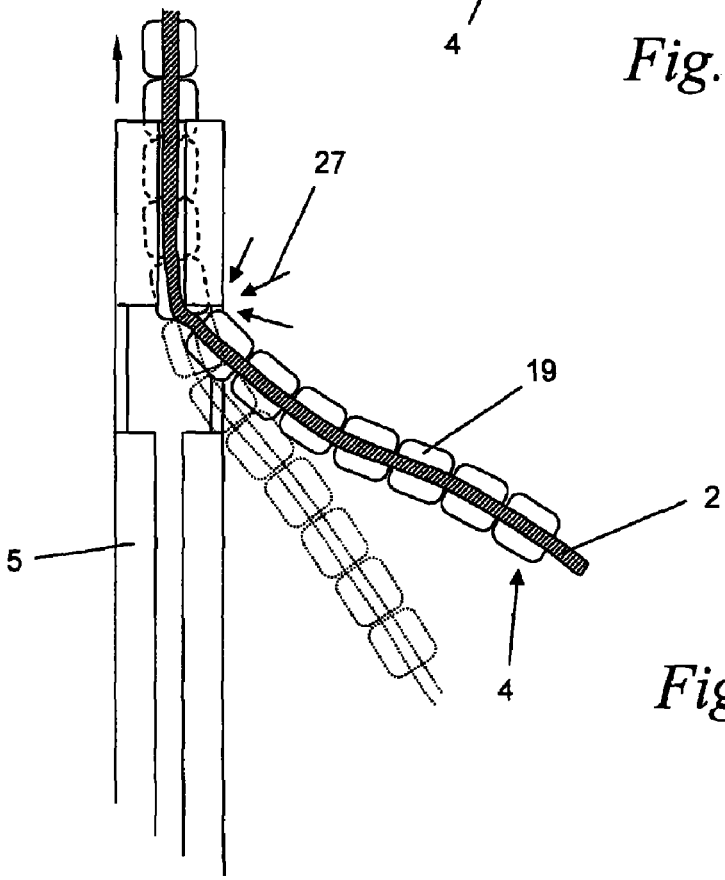
FIG. 7 is a schematic view of a longitudinal cross section of the embodiment shown in FIG. 6.

FIGS. 6 and 7 illustrate the automatic repositioning of a screen device after one of the side edges has come out of its guide channel 5. These two figures show clearly the twisting to which the edge 4, comprising a series of blocks 19, is subjected on its reinsertion into the corresponding guide channel 5.

In FIG. 7, the solid lines represent the edge 4 without an incompressible strip, whereas the dotted lines show the case in which such a strip is incorporated in this edge 4.

In the embodiment without an incompressible strip, the parts of the screen between the blocks 19 are deformed in an uncontrolled way, with the result that at the moment when the blocks 19 must engage in the guide channel 5, they catch on it at the point indicated by the arrows 27.

Another problem which may arise if the screen does not have an incompressible strip is that the side edge may enter the free space between the drum and the entry of the guide channels at the moment when the screen moves towards its closed position.

Owing to the providing of an incompressible strip near the side edge of the screen, which is less flexible than the screen, we obtain a much less pronounced deformation of the parts of the edge 4 between two successive blocks and a uniform curvature, without discontinuities, of this edge when it is reinserted in the guide channel.

Figure 8:
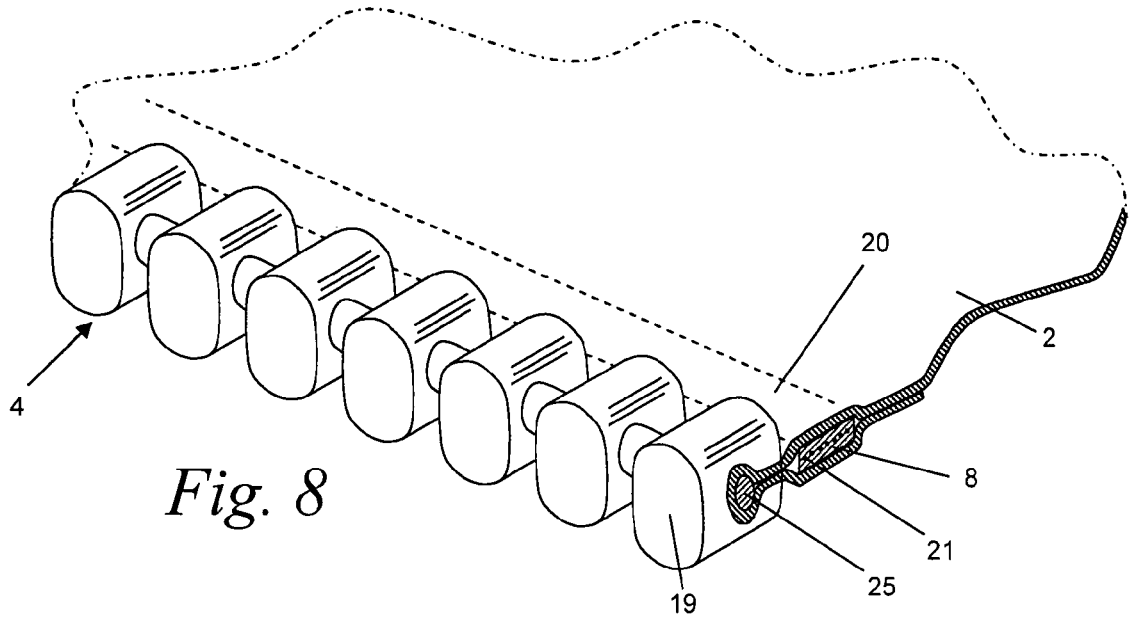
FIG. 8 is a view similar to FIG. 4 of a fourth embodiment.

FIG. 8 concerns an embodiment in which the overthickness 4' at the side edges 4 of the screen 2 is formed by a series of small blocks 19 mounted at a certain distance with respect to each other on a bead 25 consisting of textile or similar threads which is, consequently, compressible in its lengthwise direction.

In this embodiment, the strip 8 is incorporated in a sheath consisting of a fold 20 of the screen 2 near its side edges 4. This therefore makes it possible, as is the case in the embodiment as explained in relation to FIG. 7, to obtain regular, uniform and continuous bending in the form of a bow. The strip 8 may be glued in the fold 20 by both of its faces or by one of its faces.

To prevent the possibility of the bead 25 bending between two consecutive blocks 19, these blocks must move and be maintained in a guide channel (not shown in this FIG. 8). The presence of an incompressible strip 8 improves the sliding of the blocks 19 in the guide channel.

Furthermore, owing to the presence of the strip 8, the distance between two consecutive blocks may vary to a relatively large extent.

Thus, in embodiments similar to those shown in FIGS. 4, 5 and 6, the strip 8 may also be incorporated in such a fold of the screen.

Figure 9:
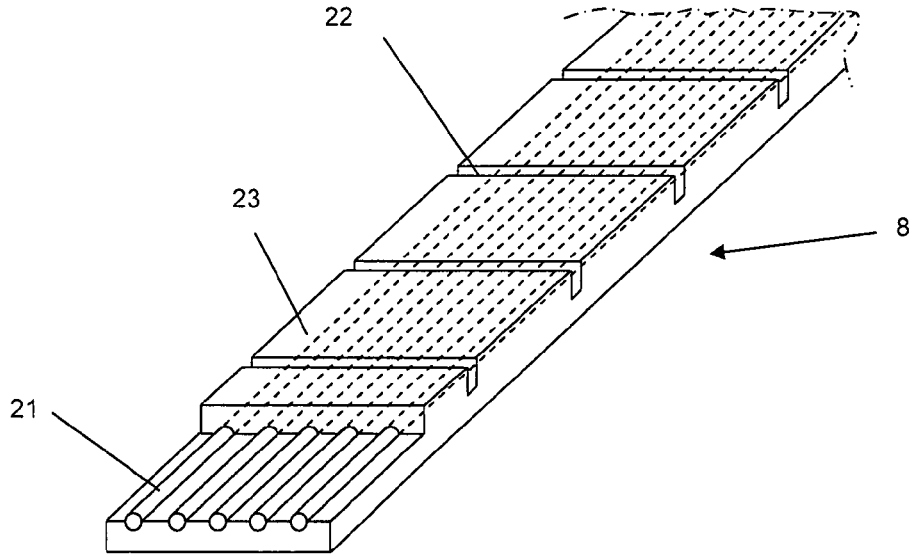
FIG. 9 is a partially broken three-dimensional view of part of an incompressible strip attached near the side edges of the screen of a device according to the invention.

FIG. 9 shows in greater detail a particular embodiment of a strip 8, formed by the cables 21 and the support 22. In this embodiment, the strip 8 presents, in its face located on the side of the centre of curvature of the screen 2 in its rolled position, a series of grooves 23 extending perpendicular to the longitudinal direction of the cables 21, in such a way as to facilitate the bending of the strip 8.

Advantageously, these grooves 23 extend as far as the cables 21.

The strip 8 is positioned in such a way with respect to the side edges 4 that the neutral surface 24 formed on bending of this strip, which was mentioned in relation to FIGS. 4 and 5, is located in the cables 21 incorporated in this strip 8.

As already mentioned in relation to FIGS. 6 and 7, it is also important that, in this specific application, the strip be sufficiently flexible to twisting.

In still another variant of the device according to the invention, the cable or cables 21 can be attached directly on the screen, for example by gluing, or else be incorporated in it in a reinforced or thicker area.

For devices with screens of a certain size or which require very frequent opening and closing at high speed, it is necessary to provide mechanical driving means, such as a motor 28 shown in FIG. 3, enabling a thrust force to be exerted on the strip 8 in its longitudinal direction to drive it. In the embodiment shown in FIG. 8, this motor may for example act on a toothed area (not shown) meshing with the blocks 19.

It is important to note that the strip 8 may occupy a very variable position with respect to the overthickness. Thus, it may be entirely contained within this overthickness, as in the first embodiment, or be located at a short distance from this overthickness, outside the guide channels and towards the interior of the screen. Another possibility is that the overthickness at least partially covers the strip, i.e. they partially overlap.

It is also important that, on bending of the overthickness 4', formed by a series of blocks 19, we obtained a bow-shaped continuous uniform curved form similar to that of the strip 8.

This requires that the distance between the overthickness and the strip be relatively limited. In fact, practical tests enable the one skilled in the art to determine the maximum distance between the strip and the overthickness to obtain the desired result which is to prevent creases from forming in the screen, especially between two consecutive blocks, when it is moved towards its closed position.

Another possibility for obtaining this result could be to keep the distance between the blocks 19 and the strip 8 smaller than the dimension of the blocks in the longitudinal direction of the side edges 4 of the screen 2.

In a variant of the device according to FIG. 8, the overthickness 4' is formed by a ridge provided near the side edges 4 of the screen 2.

When the screen 2 is mounted on a drum 3, as shown in FIGS. 1 to 3, the strip 8 can be attached to the screen 2 only with its face located on the side of the centre of curvature of the latter. This possibility has already been mentioned in relation to the embodiment shown in FIG. 8.

The cable or cables 21 preferably have a diameter of 0.5 to 4 mm. This or these cables can be trapped in separate sheaths, made of polyurethane for example, which are attached in an unremovable way on a flexible support.

In addition, this or these cables are advantageously formed from several twisted strands. This gives them better flexibility than in the case in which they consist of a single rod.

The thrust force which is exerted on the cable or cables varies between 5 and 150 kg. It is consequently important that their compression strength be sufficient to withstand this force. The advantage of having several parallel cables, as shown in the various figures, is that they enable better rolling of the screen and good rigidity when the side edges are reinserted in the guide channels, as shown in FIGS. 6 and 7.

Still another advantage is that a strip containing several parallel cables can undergo practically no deformation in a direction parallel to its large faces, as already mentioned above. Anyway, a torsion of the lateral edges 4 around their longitudinal axis remains possible in order to ease the automatic reintroduction of these side edges 4 into the guide ways.

When the screen 2 is made of a supple tarpaulin of a plastic material, such as for example PVC, that is, for example, reinforced by a fabric or a wire-mesh of polyester fibres, or any other material, the strip 8, comprising one or more steel cables, is in an advantageous way fixed to the face of the screen 2 that is directed towards the exterior of the roll formed by rolling up the screen 2. Possibly, the cables are fixed directly to this face of the screen. The fabric or the wire-mesh of polyester fibres, extending along the plane of the screen and embedded into said plastic material, is compressible along the plane of the screen, but is substantially not stretchable and thus cannot practically be elongated along this direction without damaging the screen. By fixing the strip 8 to the face of the screen 2 that is opposed to the face directed towards the centre of curvature when the screen is rolled up, the latter is not subjected to an elongation, but is somewhat compressed along the direction of the lateral edges in the neighbourhood of the latter.

Naturally, the invention is not limited to the various embodiments described above and illustrated by the appended figures, and still other variants may be envisaged without departing from the scope of this invention.

Thus, instead of notched belts, it would be possible to use on the one hand a belt presenting lugs on one of its faces and on the other hand a belt equipped with hollows in which these lugs can engage when these belts are applied against each other.

In addition, the overthickness may have very varied shapes and be formed, for example, by a ridge.

The same applies to the strip which is substantially incompressible in its lengthwise direction. This strip may be formed by any element of an elongated shape of which the transverse cross section may be very variable and may in its shape be for example circular, ellipsoidal, polygonal, etc.

Although the nature of the materials of which the cable or cables are constituted may be very variable, a marked preference is accorded to steel cables.

The invention claimed is:

1. Device for closing a doorway or other opening (1) comprising a screen (2) presenting flexible side edges (4) with an overthickness (4') extending in the longitudinal direction of the side edges (4), this overthickness (4') being guided by guide channels (5) thus enabling the screen (2) to be moved between a closed position and an open position, whereby the screen (2) is equipped with at least one cable (21), substantially incompressible in its lengthwise direction, extending substantially parallel to the side edges of the screen (2) so as to enable the application of a thrust force on these side edges (4) in their longitudinal direction to move the screen from its open position to its closed position, wherein said at least one cable (2) is incorporated in the overthickness (4'), whereby further the side edges (4) have a neutral surface (24), being a plane in which neither compression, nor any elongation takes place along the longitudinal direction of the edge when applying bending forces to the edge, the neutral surface (24) of said side edges (4) formed on bending of the cable (21) being located in this cable (21), the latter being fixed with respect to the screen (2), near each of the side edges (4) of this screen in an unremovable way preventing any movement with respect to the screen (2), driving means (28) are provided, enabling the thrust force to be exerted on the cables in their longitudinal direction which enables the movement of the screen towards it's closed position.

2. Device according to claim 1, characterised in that the screen (2) is equipped with a series of several juxtaposed cables (21) immobilised with respect to each other and extending in a plane parallel to the plane of the screen (2).

3. Device according to claim 1 or 2, characterised in that the cable or cables (21) are formed from several twisted strands.

4. Device according to claim 1 or 2, characterised in that the cable or cables (21) are maintained in an elastic support (22).

5. Device according to claim 1 or 2, characterised in that the screen has two cables (21), both of which are incorporated in the overthickness (4').

6. Device according to claim 5, characterised in that the overthickness (4') is mounted on the screen (2) in such a way as to be able to move in the guide channels (5).

7. Device according to claim 1 or 2, characterised in that said overthickness (4') fully covers the cable or cables (21).

8. Device according to claim 1 or 2, characterised in that the cable or cables (21) are incorporated in a strip (8) made of a substantially elastic material on the neutral surface (24) formed on bending of the strip (8).

9. Device according to claim 8, characterised in that, when the screen (2) is mounted on a drum (3), the strip (8) is fixed with respect to the screen (2) only with its face located on the side of the centre of curvature of the rolled screen.

10. Device for closing a doorway or other opening (1) comprising a screen (2) presenting flexible side edges (4) with an overthickness (4') extending in the longitudinal direction of the side edges (4), this overthickness (4') being guided by guide channels (5) thus enabling the screen (2) to be moved between a closed position and an open position, whereby the screen (2) is equipped with at least one cable (21), substantially incompressible in its lengthwise direction, extending substantially parallel to the side edges of the screen (2) so as to enable the application of a thrust force on these side edges (4) in their longitudinal direction to move the screen from its open position to its closed position, whereby further the side edges (4) have a neutral surface, being a plane in which neither compression, nor any elongation takes place along the longitudinal direction of the edge when applying bending forces to the edge, the neutral surface (24) of said side edges (4) formed on bending of the cable (21) being located in this cable (21), the latter being fixed with respect to the screen (2), near each of the side edges (4) of this screen in an unremovable way preventing any movement with respect to the screen (2);

wherein the cable or cables (21) are incorporated in a strip (8) made of a substantially elastic material on the neutral surface (24) formed on bending of the strip (8); and wherein said overthickness (4') comprises notched belts (9, 10) presenting a series of teeth (11, 12) and extending on either side of the plane of the screen (2) in the longitudinal direction of the side edges (4), the strip (8) being incorporated between said notched belts (9, 10).

11. Device for closing a doorway or other opening (1) comprising a screen (2) presenting flexible side edges (4) with an overthickness (4') extending in the longitudinal direction of the side edges (4), this overthickness (4') being guided by guide channels (5) thus enabling the screen (2) to be moved between a closed position and an open position, whereby the screen (2) is equipped with at least one cable (21), substantially incompressible in its lengthwise direction, extending substantially parallel to the side edges of the screen (2) so as to enable the application of a thrust force on these side edges (4) in their longitudinal direction to move the screen from its open position to its closed position, whereby further the side edges (4) have a neutral surface, being a plane in which neither compression, nor any elongation takes place along the longitudinal direction of the edge when applying bending forces to the edge, the neutral surface (24) of said side edges (4) formed on bending of the cable (21) being located in this cable (21), the latter being fixed with respect to the screen (2), near each of the side edges (4) of this screen in an unremovable way preventing any movement with respect to the screen (2); and wherein said overthickness (4') comprises notched belts (9, 10) presenting a series of teeth (11, 12) and extending on either side of the plane of the screen (2) in the longitudinal direction of the side edges (4), said at least one cable (21) being incorporated between said notched belts (9, 10).

* * * * *